United States Patent [19]

Taylor

[11] Patent Number: 4,630,709

[45] Date of Patent: Dec. 23, 1986

[54] POOL ENTRY AND EXIT DEVICE

[76] Inventor: William Taylor, 209 Park Ave., Lake Park, Fla. 33403

[21] Appl. No.: 795,636

[22] Filed: Nov. 6, 1985

[51] Int. Cl.[4] ..... A63G 21/04

[52] U.S. Cl. ..... 182/48; 182/113; 272/56.5 R; 14/69.5

[58] Field of Search ..... 182/48, 49, 222, 113, 182/152; 14/69.5, 71.7; 193/2 R; 272/56.5 R

[56] References Cited

U.S. PATENT DOCUMENTS

| | | | |
|---|---|---|---|
| 726,028 | 4/1903 | Chase . | |
| 790,613 | 5/1905 | Boyle | 272/56.5 R |
| 976,666 | 11/1910 | Lucas | 14/69.5 |
| 1,406,765 | 2/1922 | Shackle . | |
| 1,495,402 | 5/1924 | Daniel . | |
| 1,672,754 | 6/1928 | De Lisle . | |
| 2,016,891 | 10/1935 | Clarke . | |
| 2,562,339 | 7/1951 | Socol . | |
| 2,983,930 | 5/1961 | Porritt . | |
| 3,261,031 | 7/1966 | Gates . | |
| 3,796,429 | 3/1974 | Johnston | 272/56.5 R |
| 3,908,205 | 9/1975 | Chase | 272/56.5 R |
| 4,365,799 | 12/1982 | O'Brian et al. . | |
| 4,418,792 | 12/1983 | Cerone | 182/93 |
| 4,517,698 | 5/1985 | Lamp | 14/69.5 |

*Primary Examiner*—Reinaldo P. Machado
*Attorney, Agent, or Firm*—Steele, Gould & Fried

[57] ABSTRACT

A pool entry and exit device is provided for use by non-ambulatory persons and includes ramp structure defining a substantially planar surface extending from a position above the pool deck at a height substantially equal to the height of a wheelchair seat and extending angularly downward to a position at least adjacent to the surface of the water. Support structure is adapted to position the ramp structure above the pool deck. Handrail structure is secured to at least one of the ramp structure and the support structure such that the individual may grasp the handrails and safely enter or exit the pool with a minimum of effort. Structure is provided such that the device may be conveniently stored when not in use.

15 Claims, 7 Drawing Figures

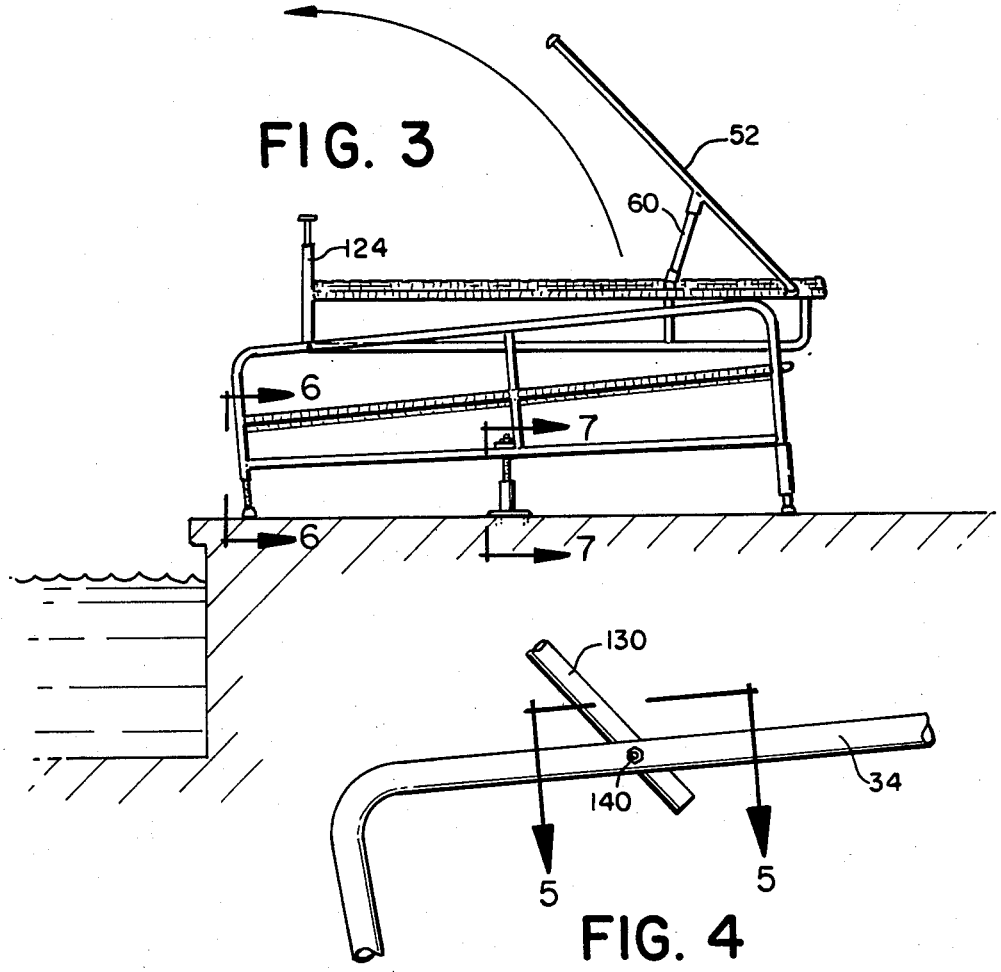
FIG. 3
FIG. 4
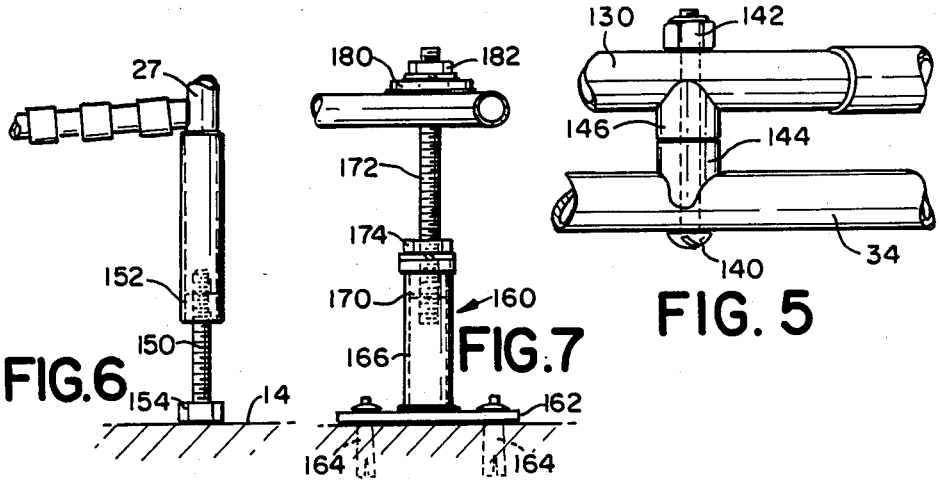
FIG.6
FIG.7
FIG. 5

POOL ENTRY AND EXIT DEVICE

BACKGROUND OF THE INVENTION

1. Field of the Invention

This invention relates generally to devices for entering and exiting pools, and particular to such devices that are designed especially to be of assistance to non-ambulatory persons.

2. Description of the Prior Art

It is known that swimming can be an excellent source of exercise for non-ambulatory persons. It is difficult, however, for persons confined to a wheelchair to make the transistion from their wheelchair to the pool. Cerone, U.S. Pat. No. 4,418,792, discloses a pool ladder for use by individuals confined to a wheelchair which is comprised of rail members affixed to the pool deck and wall. Steps, beginning at the height of a wheelchair seat above the pool deck, descend into the water such that the user may lower himself or herself step to step with the aid of the handrails. The user must progress downward by the somewhat unsteady and uncomfortable process of a series of drops from step to step. More importantly, during exit from the pool the user must perform a series of lifts from one step up to the next, which can be a tedious process. Also, the ladder is permanently mounted in the pool and thus can be an obstacle to the complete utilization of the pool area when the ladder is not in use.

It is known that ladders and especially pool ladders can be made pivotable for a variety of different purposes including convenience and safety. Examples of these invention include those disclosed by Fairchild, U.S. Pat. No. 502,070; Aken, U.S. Pat. No. 2,721,345; Kunzweiler, U.S. Pat. No. 3,586,124; Gannon, U.S. Pat. No. 3,908,795; and Martinez, U.S. Pat. No. 3,973,646. Different mounting means for pool ladders have been disclosed, including that by Whitten, Jr., U.S. Pat. No. 3,420,558.

It would be desirable to have a pool entrance and exit device for non-ambulatory persons which does not utilize the steps commonly found in such devices. It would also be desirable to provide such a device which could be removed from the pool area when not is use. Sturdy construction is of course also desirable.

SUMMARY OF THE INVENTION

It is an object of the present invention to provide a pool entry and exit device for non-ambulatory persons which provides easy access and exit to the pool.

It is another object of the present invention to provide a device which is safe to use.

It is still another object of the present invention to provide a device which can be conveniently removed from the swimming area when not in use.

It is yet another object of the invention to provide a device which folds compactly when not in use.

· It is another object of the invention to provide a device which can be easily installed.

It is still another object of the invention to provide a device which can be completely removed from the pool deck area with a minimum of effort.

It is another object of the invention to provide a device of sturdy construction.

These and other objects are accomplished by a pool entry and exit device with ramp means defining a substantially planar surface extending from a position above the pool deck at a height substantially equal to the height of a wheelchair seat and extending angularly downward to a position at least adjacent the surface of the water. Support means are adapted to secure the ramp means above the pool deck. Handrail means are secured to at least one of the ramp means and the support means.

The ramp means are preferably formed by at least upper and lower portions. The portions are linked by hinge means. Brace means extend from the lower portion to the side wall of the pool to support the lower portion under the weight of a user. The brace means preferably comprise at least two spatially separated brace members, one on each lateral side of the lower portion. Additional brace members can extend from the spatially separated brace members to the lower portion of the ramp means.

Handrails are preferably provided and can be joined to at least one of the ramp means and the support means. The handrail means preferably includes a rail member positioned over and substantially parallel to each lateral side of the ramp portions.

The support means preferably comprise vertical leg members. Preferably at least some of the vertical leg members include leveling means. The leveling means may comprise foot pads threadably mounted to and adjustable with the vertical leg members. The device preferably comprises attachement means which are preferably threadably secured to the pool deck.

The lower portion is preferably dimensioned such that when it is pivoted about the hinge means it fits between the handrail means of the upper portion for convenient storage.

The ramp means is preferably provided by suitable structure such as plastic strapping or webbing. The ramp means could also be provided by a substantially continuous surface such as a solid rubber surface which may additionally have a support backing.

BRIEF DESCRIPTION OF THE DRAWINGS

There is shown in the drawings embodiments which are presently preferred it being understood, however, that the invention is not limited to the precise instrumentalities and arrangement shown:

FIG. 3 is a side elevation of the invention in a second position.

FIG. 4 is a side elevation of a hinge joint according to the invention.

FIG. 5 is a plan view taken along line 5—5 in FIG. 4.

FIG. 6 is a side elevation, partially in phantom, taken along line 6—6 in FIG. 3.

FIG. 7 is a side elevation, partially in phantom, taken along line 7—7 in FIG. 3.

DESCRIPTION OF THE PREFERRED EMBODIMENTS

Figure 1:
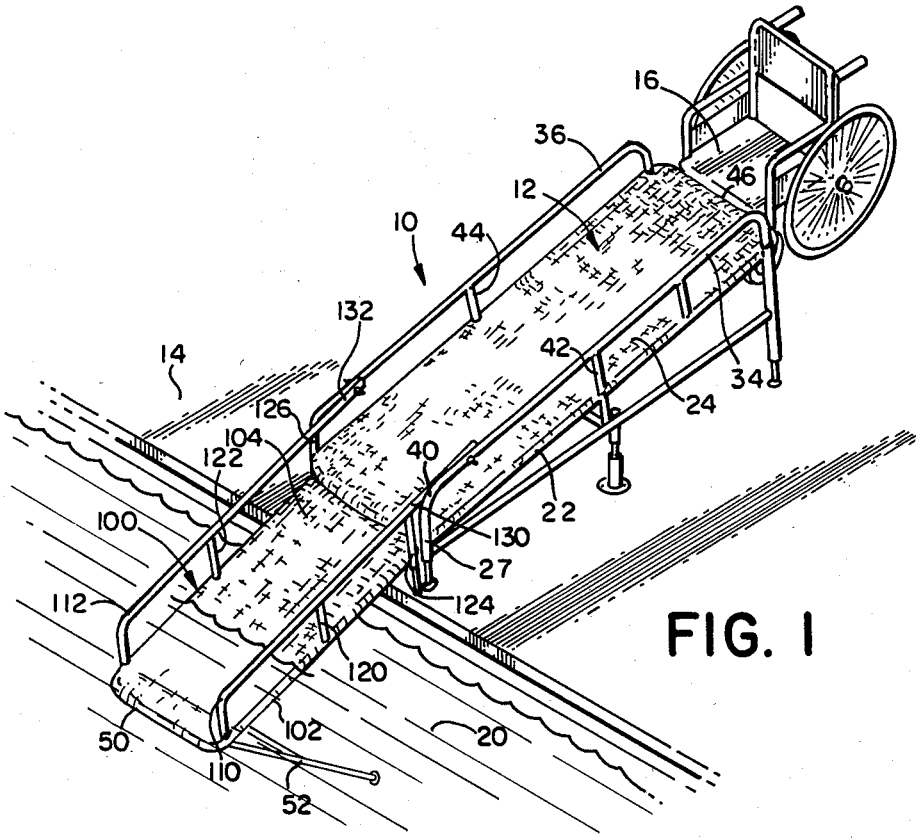
FIG. 1 is a perspective of a pool entry and exit device according to the invention.
Figure 2:
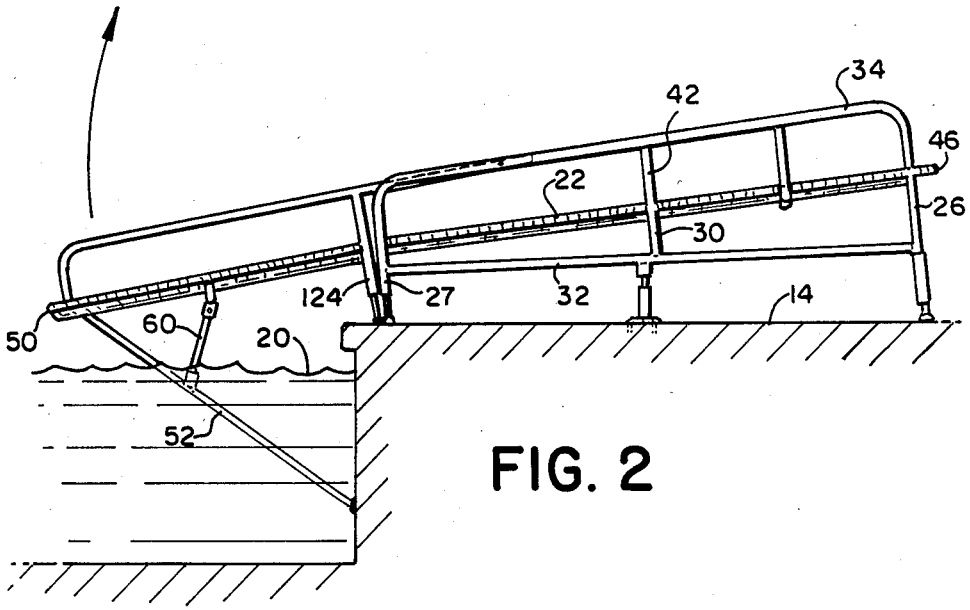
FIG. 2 is a side elevation of the invention in a first position.

Referring to FIGS. 1–2 there is shown a pool entry and exit device 10 according to the invention for assisting non-ambulatory persons into and out of pools. The device includes ramp structure 12 extending angularly downward from a position above the pool deck 14, at a height substantially equal to the height of a wheelchair seat 16, to a position at least adjacent to the surface of the water 20. Support structure is adapted to position the ramp structure above the pool deck. Hand rail structure is preferably provided and secured to at least one of the ramp structure and the support structure to assist the user in traversing the ramp.

The ramp structure can be conventiently provided as a substantially rectangular framework 22 of tubular members. The substantially planar structure may be supported by plastic webbing or strapping 24 suspended from the framework 22 in a suitable manner as is known in the art. It may alternatively be desirable to provide the ramp structure as a continuous sheet of a suitable material supported by, or forming a part of the framework 22. It is desirable, whatever the construction, that the surface of the ramp structure not be too slippery. Friction helps the user in exiting the pool by resisting the force of gravity which would act to continuously pull the user down the ramp. Friction generated by the ramp also increases safety on entering the pool as it resists the tendency of gravity to slide the user into the pool before he or she may be ready should the user loose grip of the handrails.

The support structure can be conveniently provided as a plurality of vertical leg members 26, 27 and other not visible in the drawings. The support structure may include other members such as vertical member 30 and horizontal member 32 to strengthen and stabilize the device.

Handrail structure is preferably provided as rails 34, 36 extending above and parallel to each lateral side of the ramp structure 12. The rails 34, 36 may be affixed to either or both the support structure and the ramp structure. It would also be apparent to one skilled in the art that the hand rail structure and the support structure could be conveniently formed from a continuous piece of material as shown for the vertical leg member 27, which is formed from a substantially right angle bend 40 in the rail 34. The handrail structure may also include additional strengthening members such as handrail supports 42, 44 connecting the handrails to the framework 22.

The handrail structure provides a secure means for the user to push or pull himself or herself up or down the ramp. The rails 34, 36 provide a firm grip for the user at a comfortable and efficient position. The rails 34, 36 also help to confine the user to the ramp and prevent falls sideways off of the ramp. The ramp structure itself might be fashioned at each lateral edge to perform the funcation of handrail structure. A lateral bow in the ramp structure may also aid in containing the user to the center of the ramp structure. The device so provided is therefore seen to be a very safe one to use for non-ambulatory persons who may also have other impairments such as poor eyesight which might hamper balance and stability while on the device.

An end 46 of the ramp structure 12 is preferably positioned at a height equivalent to the height of a wheelchair seat 16. In operation, the user positions the chair adjacent the end 46 and grasps the rails 34, 36. The user can then pull and lift himself or herself onto the ramp structure 12. The user can then use the rails 34, 36 to assist himself or herself in moving down the ramp 12. The ramp extends angularly downward toward the surface 20 of the water in the pool such that a lower end 50 of the ramp is at least adjacent the surface 20 of the water and preferably is a short distance below the surface of the water. In this manner the user can transport himself or herself safely from the wheelchair into the water in a very stable and secure fashion.

When exit from the pool is desired, the user positions himself or herself facing the lower end 50 of the ramp 12. Grasping the handrails 34, 36, the user pulls himself or herself onto the ramp. If the ramp extends a short distance below the surface of the water, it is apparent that the buoyancy exerted by the water on the body will assist in positioning oneself onto the ramp. The user then uses the rails 34, 36 to pull or push himself or herself up the ramp. A sideways rocking motion combined with pushing or pulling on the handrails will result in relatively easy ascension up the ramp.

It is apparent that the provision of the continuous ramp surface allows the user to move up or down the ramp in movements as large or small as are desired and as the user is capable of. The user is not constrained by the spacing between steps or the like. Also, it is apparent that the continuous surface would prevent jarring which might occur as one drops oneself from one step down to a lower step. The ramp also would allow one to move up the ramp without performing a series of difficult lifts from one step to a higher step. This can be especially beneficial when the user has already become tired through exercise in the pool.

The ramp 12 will normally extend a good measure past the edge of the pool deck into the pool in order that its angle of incline into the pool is not too steep and in order that the lower end 50 is positioned at least adjacent to, and preferably below, the surface of the water 20. It is desirable to support the portion of the ramp beyond the edge of the pool deck by the provision of bracing structure. Bracing structure can be conveniently provided as two spatially separated brace members 52, one located on each lateral side of the ramp, where they are affixed preferably at or near the lower end 50. Each brace member 52 extends angularly from its place of attachment to the ramp 12, near the lower end 50, to the adjacent wall 54 of the pool. The end 56 of the brace member 52 may have a non-skid foot pad or the like affixed thereto at such an angle that it evenly seats against the wall 54. Further support can be provided by additional brace members 60 which extend from the brace members 52 to the ramp 12.

The lower portion of the device extends into the swimming area and can interfere with complete utilization of the pool. It is therefore desirable to provide the device with structure such that the lower portion may be easily moved away from the swimming area when not in use without moving the device itself. This can be accomplished by making the lower portion extending into the swimming area movable relative to the upper portion on the pool deck. An effective design would have the lower portion pivotable relative to the upper portion such that, when not in use, the lower portion can be swung upward and out of the swimming area as shown by the arrows in FIGS. 2 and 3. In such a design, an upper camp portion over the pool deck could have a design as previously described, but would not extend substantially beyond the pool deck. A lower ramp portion would preferably have its own framework, handrail and support structure, but should be provided such that it forms a substantially continuous planar surface with the ramp of the upper portion when the lower portion is positioned in the pool.

The lower ramp portion is generally designated 100 in the Figures. It preferably includes webbing or strapping 104 suspended from a framework 102. Hand rail structure 110, 112 is positioned above the lateral sides of the framework 102. The handrail structure 110, 112 can be additionally supported by lower portion handrail brace members 120, 122 connecting the handrails with the framework 102. Lower portion vertical support members 124, 126 support the lower ramp portion 100 on the pool deck 14. Additional bracing members 52 and 60 may support the lower portion as previously described.

Rearward extensions 130, 132 of the handrails 110, 112 are secured to the handrail structure 34, 36 of the upper ramp portion by hinge means, preferably as shown in FIG. 4 and FIG. 5. The hinge means is conveniently provided as a bolt 140 or the like rotatably connecting the handrails of the lower portion to the handrails of the upper portion portion, and secured by means such as nut 142. Housing members 144, 146 may additionally be mounted to the rail members 34, 130, respectively, to space the rail members and to provide a smooth and even appearance. While a particular hinge structure has been disclosed, it would be apparent to one skilled in the art that alternative positioning and construction of the hinge means is possible. The hinge means could be provided between the framework 22 of the upper ramp portion and the framework 102 of the lower ramp portion.

It is desirable that the lower ramp portion neatly interfit with the upper ramp portion when piovted out of the pool so as to take up a minimum of space above the pool deck 14. This can be accomplished if the lower portion 100 is generally of a width less than the width between the rails 34, 36 of the upper ramp portion. The lower ramp portion 100 would then pivot to a position where it nests compactly within the handrails 34, 36 of the upper ramp portion as shown in FIG. 3. It may also be desirable to provided more than two hinged portions such that the device could be stored even more compactly by a series of pivots.

It is desirable if the height of the end 46 of the device is at a height substantially equal to the height of the wheelchair seat 16 such that a smooth transition from the wheelchair to the ramp is made possible. The height of the wheelchair seat 16 may of course vary. It is therefore desirable to provide structure which can raise or lower the ramp as necessary. Such structure is depicted in FIG. 6, where the vertical support member 27 is shown with a threaded shaft 150 being received by a nut 152 fixed to the interior of the vertical support 27. Rotation of the threaded shaft 150 in one direction or the other will cause a raising or lowering of the shaft 150 to effect leveling as is known in the art. A foot pad 154 can be provided at the end of the shaft 150 to contact the pool deck 14 to prevent marring. Alternative leveling structure is possible according to methods known in the art.

It is possible for safety purposes to provide structure for securing the device to the pool deck 14. Suitable structure is shown in FIG. 7. A seat 160 would include a base portion 162 fixed to the pool deck 14 by suitable fasteners 164. The seat 160 would include an upstanding hollow cylindrical portion 166. A nut 170 is fixed to the interior of the cylinder 166. A threaded shaft 172 having a nut 174 threaded thereon is received in the nut 170 in the upstanding cylinder 166. The nut 174 bears against suitable structure provided on the upwardly distal end of the cylinder 166 to lock the shaft 172 in place. The shaft 172 passes upwardly through a bore (not shown) in suitable receiving structure affixed to the device. This receiving structure may be a plate 180 bearing a nut 182 and affixed to the member 32. The nut 182 threadably receives the shaft 172. In this manner, as would be apparent to one skilled in the art, rotation of the shaft 172 in the nut 182 and 170, together with positioning of the locking nut 174 on the shaft 172, will effectuate securing the device to the pool deck. The device is safely secured to the pool deck 14 while upward or downward positioning according to the desired level of the ramp remains possible. It is preferable to provide engagement structure on each lateral side of the device to provide secure attachment to the pool deck 14 and to resist twisting of the ramp. Alternative attachment structure is possible, as would be apparent to one skilled in the art.

The handrails and framework of the device are preferably made from tubular components which are both lightweight and sturdy. Examples of suitable materials, though not limiting, would include aluminum and PVC. The components would be secured together by methods which would be apparent to one skilled in the art including riveting, gluing, welding, and screwing. The webbing or strapping can be made of a number of materials, but should preferably exhibit the properties of strength and weather resistance. Examples would include plastic strapping and nylon weave materials as are commonplace in outdoor furniture. These materials can be fastened to the framework by methods known in the art. It alternatively is possible to provide a continous solid sheet material, which may or may not have support in addition to the framework. The threaded shafts and the seats are preferably provided by strong and weather resistant materials such as a quality stainless steel.

It would be apparent to one skilled in the art that a variety of alternative constructions could be provided within the spirit of the invention. References should accordingly be made to the appended claims, rather than the foregoing specification, as indicating the scope of the invention.

I claim:

1. A foldable pool entry and exit device for use by non-ambulatory persons comprising:

ramp means comprising at least upper and lower ramp portions, the portions being linked by hinge means, the ramp surface comprising a friction material adapted to prevent slippage; and, support means adapted to position the upper ramp means above the pool deck at a height substantially equal to the height of a wheel chair seat such that the ramp means extends angularly downward at a gentle slope to a position at least adjacent the surface of the water, at least a portion of said lower ramp portion extending over the water, whereby the user can enter and exit the water in a controlled fashion and with a minimum of exertion, and whereby the lower ramp portion can be pivoted out of the swimming area and folded to overlap the upper ramp portion when not in use.

2. The pool entry and exit device according of claim 1, further comprising hand rail means secured to at least one of the ramp means and the support means.

3. The pool entry and exit device of claim 2 further comprising brace means extending from the lower ramp portion to a side wall of the pool.

4. The pool entry and exit device of claim 3 wherein the brace means comprises at least two spatially separated brace members, one on each lateral side of the lower ramp portion.

5. The pool entry and exit device of claim 4 wherein at least one additional brace member extends from each of the at least two spatially separated brace members to the the lower ramp portion.

6. The pool entry and exit device of claim 3 wherein the hand rail means, the support means and the brace means are formed from tubular members.

7. The pool entry and exit device of claim 2 wherein the support means comprises vertical leg members affixed to the ramp means.

8. The pool entry and exit device of claim 8 wherein the support means includes adjustable foot means at the base of at least two of the vertical leg members.

9. The pool entry and exit device of claim 8 wherein the adjustable foot means comprises foot pads threadably mounted to and adjustable with the vertical leg members.

10. The pool entry and exit device of claim 7 wherein the support means further comprises vertical leg members threadably secured to the pool deck.

11. The pool entry and exit device of claim 2 wherein the hand rail means includes a rail member positioned over and substantially parallel to each lateral side of the at least upper and lower ramp portions.

12. The pool entry and exit device of claim 3 wherein the lower portion is dimensioned such that when it is pivoted about the hinge means it fits between the hand rail means of the upper ramp portion for convenient storage.

13. The pool entry and exit device of claim 2 wherein the ramp means comprises a framework and web elements affixed to the framework.

14. The pool entry and exit device of claim 2 further comprising attachment means for securing the device to the pool deck.

15. The pool entry and exit device of claiam 14 wherein the attachment means comprises threaded engagement structure on the device and threaded engagement structure secured to the pool deck, at least one threaded shaft connecting the engagement structure on the device to the engagement structure on the pool deck.

* * * * *